US012773611B2

(12) United States Patent
Eisenbarth et al.

(10) Patent No.: US 12,773,611 B2
(45) Date of Patent: Oct. 27, 2026

(54) ROTATING CLIMBING WALL

(71) Applicant: Nectar Climbing, LLC, Murray, UT (US)

(72) Inventors: Adam Eisenbarth, Salt Lake City, UT (US); Keqing Li, San Francisco, CA (US)

(73) Assignee: Nectar Climbing, LLC, Murray, UT (US)

( * ) Notice: Subject to any disclaimer, the term of this patent is extended or adjusted under 35 U.S.C. 154(b) by 81 days.

(21) Appl. No.: 18/816,645

(22) Filed: Aug. 27, 2024

(65) Prior Publication Data

US 2026/0061282 A1 Mar. 5, 2026

(51) Int. Cl.
*A63B 69/00* (2006.01)

(52) U.S. Cl.
CPC ..... *A63B 69/0048* (2013.01); *A63B 2225/74* (2020.08)

(58) Field of Classification Search
CPC ..... A63B 69/0048; A63B 2225/74; A63B 22/02–0292; A63B 69/0035
See application file for complete search history.

(56) References Cited

U.S. PATENT DOCUMENTS 1,734,654 A * 11/1929 Rafael ..... D06F 89/00 38/2
4,056,289 A * 11/1977 Gilliland ..... B62D 55/07 305/120
5,125,877 A * 6/1992 Brewer ..... A63B 69/0048 482/37
5,549,195 A * 8/1996 Aulagner ..... B65G 17/067 482/37
5,919,117 A * 7/1999 Thompson ..... A63B 22/025 482/37
6,042,514 A * 3/2000 Abelbeck ..... A63B 22/02 482/54
6,095,952 A * 8/2000 Ali ..... A63B 22/02 482/54
6,231,482 B1 * 5/2001 Thompson ..... A63B 24/00 482/37
6,860,836 B1 * 3/2005 Wu ..... A63B 69/0048 482/37
7,195,582 B2 * 3/2007 Wu ..... A63B 22/001 482/37

(Continued)

FOREIGN PATENT DOCUMENTS

CN 1439436 A * 9/2003
CN 106215394 A * 12/2016 ..... A63B 9/0048

(Continued)

*Primary Examiner* — Nyca T Nguyen
(74) *Attorney, Agent, or Firm* — Kirton McConkie; Brian Tucker

(57) ABSTRACT

The present disclosure extends to a rotating climbing wall. Slats of the rotating climbing wall can be pinned together to form a loop of slats that functions similar to a chain. The pinned-together slats minimize pinch points. The slats may include rack gears that are driven by pinion gears positioned at the top and bottom of the loop of slats. The slats may include coupling blocks that interface with coupling faces formed on rails to minimize sagging. The slats may include lights that include central openings through which holds are mounted to the slats.

19 Claims, 9 Drawing Sheets

(56) References Cited

U.S. PATENT DOCUMENTS

| | | | | |
|---|---|---|---|---|
| 7,819,778 | B1 * | 10/2010 | Sudeith | A63B 71/0054 482/37 |
| 8,668,626 | B1 * | 3/2014 | Horowitz | A63B 71/0605 482/37 |
| 9,017,224 | B1 * | 4/2015 | Singley | A63B 22/0005 482/52 |
| 9,770,614 | B1 * | 9/2017 | Sudeith | A63B 71/0009 |
| 9,795,828 | B2 * | 10/2017 | Andrade | A63B 22/0046 |
| 10,478,666 | B2 * | 11/2019 | Yoo | A63B 22/0214 |
| 10,821,320 | B2 * | 11/2020 | Lo | A63B 22/0214 |
| 11,007,404 | B2 * | 5/2021 | Yoo | A63B 22/02 |
| 11,027,183 | B2 * | 6/2021 | Brewer | A63B 69/0048 |
| 2003/0060333 | A1 * | 3/2003 | Sudeith | A63B 69/0048 482/37 |
| 2006/0240949 | A1 * | 10/2006 | Wu | A63B 22/04 482/37 |
| 2008/0015090 | A1 * | 1/2008 | Brewer | A63B 69/0048 482/37 |
| 2016/0136496 | A1 * | 5/2016 | Garnier | A63B 71/0605 315/76 |
| 2018/0369630 | A1 * | 12/2018 | Sudeith | A63B 9/00 |
| 2019/0329113 | A1 * | 10/2019 | Parsons | A63B 69/0048 |
| 2020/0023257 | A1 * | 1/2020 | Speed | A63B 69/0048 |
| 2021/0275888 | A1 * | 9/2021 | Speed | A63B 69/0048 |
| 2023/0381620 | A1 * | 11/2023 | Kaner | B25J 15/0019 |

FOREIGN PATENT DOCUMENTS

| | | | | | |
|---|---|---|---|---|---|
| CN | 108295451 | A | * | 7/2018 | A63B 69/00 |
| CN | 108721857 | A | * | 11/2018 | A63B 69/0048 |
| DE | 3815564 | A1 | * | 11/1989 | A63B 69/0048 |
| DE | 202012104073 | U1 | * | 1/2013 | A63B 69/0048 |
| ES | 2385599 | A1 | * | 7/2012 | A63B 69/0048 |
| FR | 2780291 | A1 | * | 12/1999 | A63B 69/0048 |
| IT | 201800009375 | A1 | * | 4/2020 | A63B 69/0048 |
| KR | 101737868 | B1 | * | 5/2017 | A63B 71/0054 |
| KR | 20200120086 | A | * | 10/2020 | A63B 22/0242 |
| KR | 102249103 | B1 | * | 5/2021 | A63B 22/0207 |
| KR | 102301954 | B1 | * | 9/2021 | A63B 69/0048 |
| SI | 21729 | A | * | 10/2005 | |
| WO | WO-9111226 | A1 | * | 8/1991 | A63B 69/0048 |
| WO | WO-2022108991 | A2 | * | 5/2022 | A63B 69/0048 |

* cited by examiner

ROTATING CLIMBING WALL

CROSS-REFERENCE TO RELATED APPLICATIONS

Aspects of the present disclosure may be used in conjunction with embodiments of the rotating climbing wall described in U.S. patent application Ser. No. 18/159,303 which is incorporated by reference.

BACKGROUND

Various rotating climbing walls have been developed. These rotating climbing walls are configured similar to a treadmill in that the climbing surface forms an infinite loop. Typically, the climbing surface is formed by parallel slats to which holds are attached.

BRIEF SUMMARY

The present disclosure extends to a rotating climbing wall. Slats of the rotating climbing wall can be pinned together to form a loop of slats that functions similar to a chain. The pinned-together slats minimize pinch points. The slats may include rack gears that are driven by pinion gears positioned at the top and bottom of the loop of slats. The slats may include coupling blocks that interface with coupling faces formed on rails to minimize sagging. The slats may include lights that include central openings through which holds are mounted to the slats.

In some embodiments, a rotating climbing wall includes a board assembly comprising a plurality of slats. Each slat is pinned to adjacent slats to form a loop of slats.

In some embodiments, each slat includes a series of channels that are spaced along a top and a bottom of the slat. Each series of channels aligns with a corresponding series of channels on an adjacent slat. A pin extends through the aligned series of channels of adjacent slats to pin the adjacent slats together.

In some embodiments, an outer surface of the channels is rounded.

In some embodiments, the board assembly also includes a plurality of uprights around which the slats rotate. Each upright forms opposing rails having inwardly oriented coupling faces. Each slat includes coupling blocks for coupling the slat to the opposing rails. Each coupling block includes opposing retaining members that are secured against the inwardly oriented coupling faces.

In some embodiments, the inwardly oriented coupling faces are flat surfaces oriented at an angle between 30 and 60 degrees relative to a longitudinal axis of the corresponding slat.

In some embodiments, the board assembly includes one or more pairs of pinions gears positioned at opposing ends of the loop of slats. The slats include rack gears that engage with the pinion gears.

In some embodiments, each slat includes a rack gear for each pair of pinion gears.

In some embodiments, the board assembly includes multiple pairs of pinion gears.

In some embodiments, each pinion gear and each rack gear includes spaced large teeth with a series of small teeth in between.

In some embodiments, one or more of the slats are configured to receive lights that each have a central opening through which a hold is mounted to the slat.

In some embodiments, the one or more slats include openings with recessed surfaces that are configured to receive the lights.

In some embodiments, each of the one or more slats includes a cover in which hold securing members are positioned. The cover is positioned overtop one or more hollow portions of the slat within which wiring of the lights is routed.

In some embodiments, each hold securing member includes a threaded portion that aligns with the central opening of a corresponding light.

In some embodiments, a slat for a rotating climbing wall includes an outer surface, openings through the outer surface, lights that are positioned in the openings, each light having a central opening, an inner surface, and hold securing members positioned in the inner surface to align with the openings. Each hold securing member includes a portion that aligns with the central opening of the respective light and is configured to receive a hold that extends through the central opening.

In some embodiments, the inner surface of the slat is formed by a removable cover in which the hold securing members are positioned.

In some embodiments, the openings in the slat include recessed surfaces against which the lights are positioned.

In some embodiments, the slat includes one or more gears attached to the inner surface.

In some embodiments, a rotating climbing wall includes interconnected slats that form a loop, rack gears attached to the slats, and opposing pinion gears that engage with the rack gears to rotate the interconnected slats.

In some embodiments, each slat includes a separate rack gear that engages with the opposing pinion gears.

In some embodiments, the slats are interconnected by aligning channels of adjacent slats and inserting a pin through the aligned channels.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
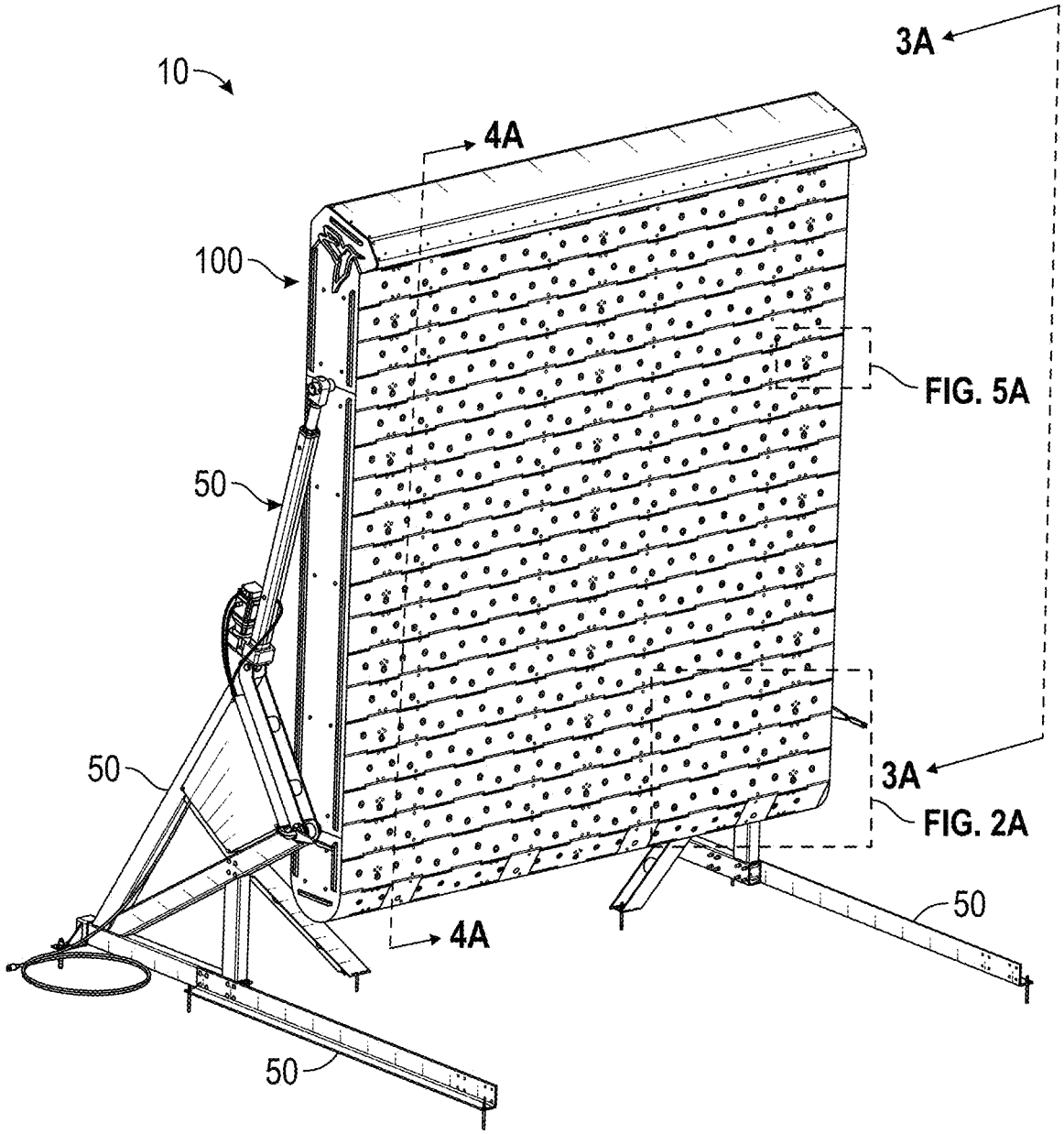
FIG. 1 is a front, perspective view of a rotating climbing wall that is configured in accordance with one or more embodiments of the present disclosure.

FIG. 1 is a front perspective view of a rotating climbing wall 10 that is configured in accordance with one or more embodiments of the present disclosure. Rotating climbing wall 10 includes a support assembly 50 and a board assembly 100. Support assembly 50 is configured to support board assembly 100 off the ground and to orient board assembly 100 at a desired angle. Board assembly 100, which does not include holds in the figures, forms a climbing surface that rotates to provide a continuous climbing experience.

In the depicted embodiment, support assembly 50 is configured to be secured to the floor. However, in other embodiments, a support assembly could be configured to be secured to a wall or any other structure. Also, in some embodiments, a support assembly could be integrated into the ground, a wall, or any other structure where board assembly 100 may be used. In short, board assembly 100 could be supported in a wide variety of ways.

In some embodiments, rotating climbing wall 10 may include one or more features disclosed in U.S. patent application Ser. No. 18/159,303. Additionally or alternatively, one or more of the features described herein could be used on a rotating climbing wall as described in U.S. patent application Ser. No. 18/159,303. Furthermore, any or all of the features described herein could be used on any other rotating climbing wall. Accordingly, the described features should not be limited to any particular rotating climbing wall configuration.

Figure 2A:
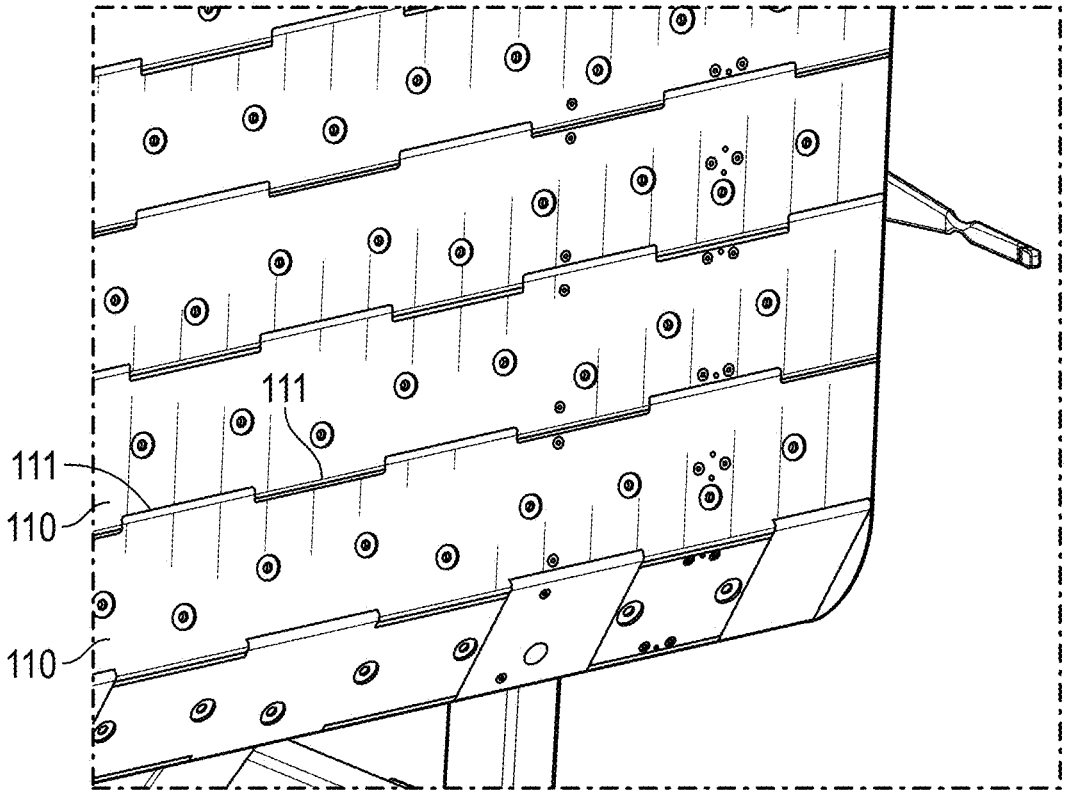
FIG. 2A shows slats that may be used on a rotating climbing wall in accordance with one or more embodiments of the present disclosure.
Figure 2B:
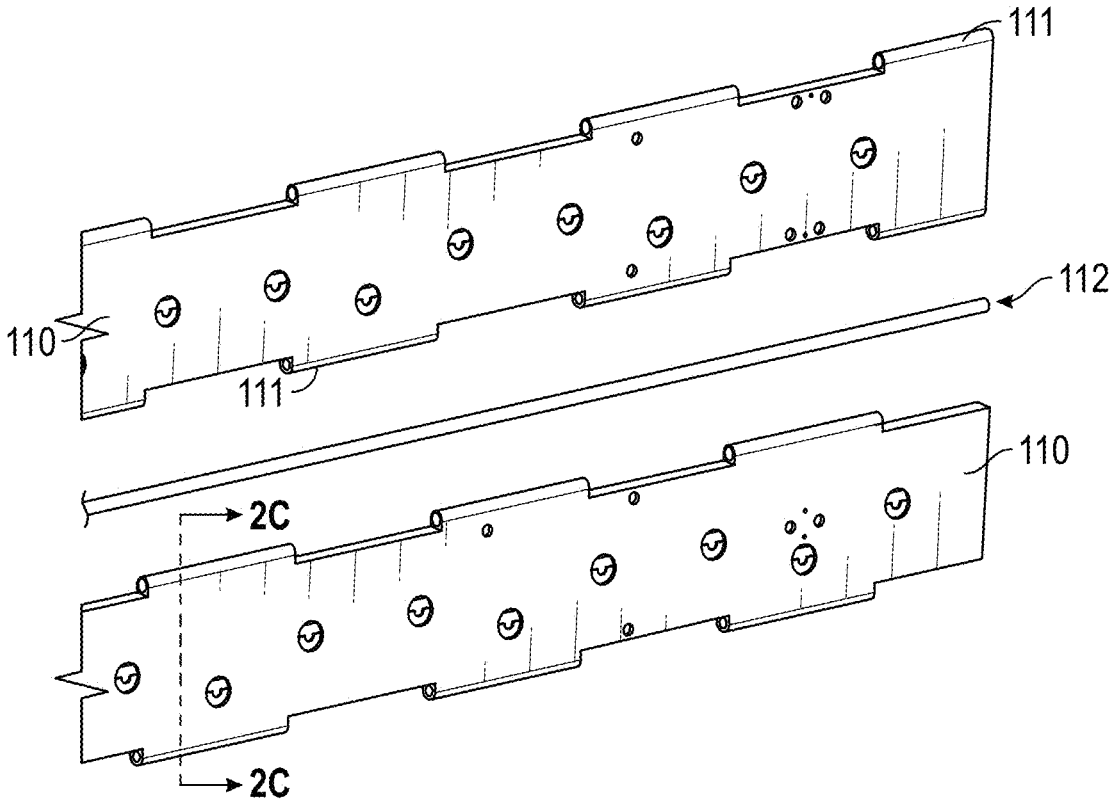
FIG. 2B is an exploded view of the slats of FIG. 2A.
Figure 2C:
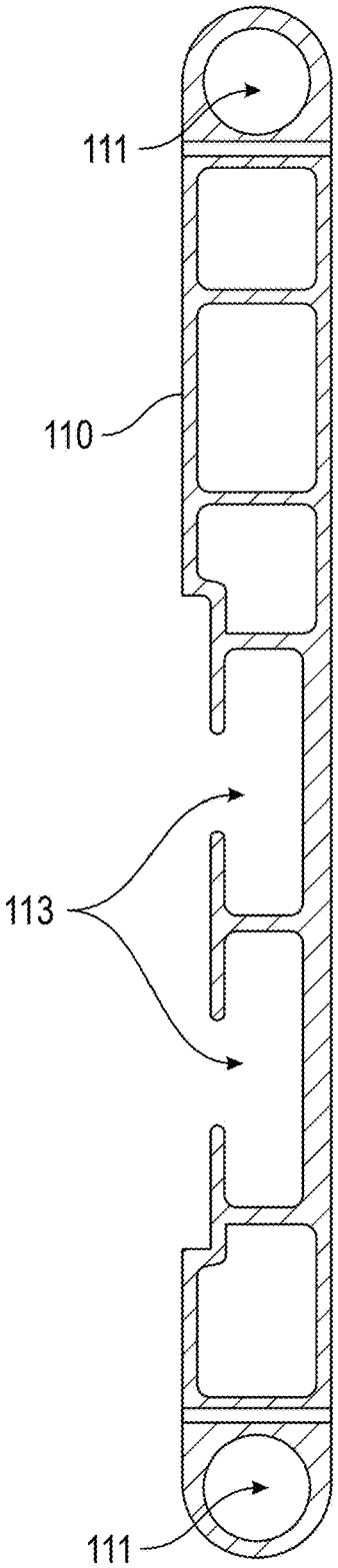
FIG. 2C is a cross-sectional side view of a slat of FIG. 2A.

In some embodiments, rotating climbing wall 10 may include slats 110 that are interconnected by being pinned to adjacent slats 110 (e.g., the slats that are above and below the slat). FIGS. 2A-2C provide an example of such pinned slats 110.

Each slat 110 may include a series of channels 111 that are spaced along the top and bottom of the slat. In this context, "top" and "bottom" are relative terms and represent the opposing longer sides of each slat 110. Channels 111 on different slats 110 can have corresponding patterns so that channels 111 of two adjacent slats 110 align to thereby allow a pin 112 to be inserted through the channels to interlock the slats. This alignment and interlocking of channels 111 minimizes pinch points. In some embodiments, such as is best shown in FIG. 2C, channels 111 can have a rounded external surface to further minimize any pinch points.

In some embodiments, this pinning of slats 110 causes the slats to function as a chain. In other words, once all slats 110 are pinned together, slats 110 will form a full loop where each slat 110 functions in a similar manner as a link of a chain.

FIG. 2C also shows that, in some embodiments, some or all of slats 110 may have hollow portions 113 that are open at the rear of slat 110. Hollow portions 113 may facilitate the integration of lights as described below.

Figure 3A:
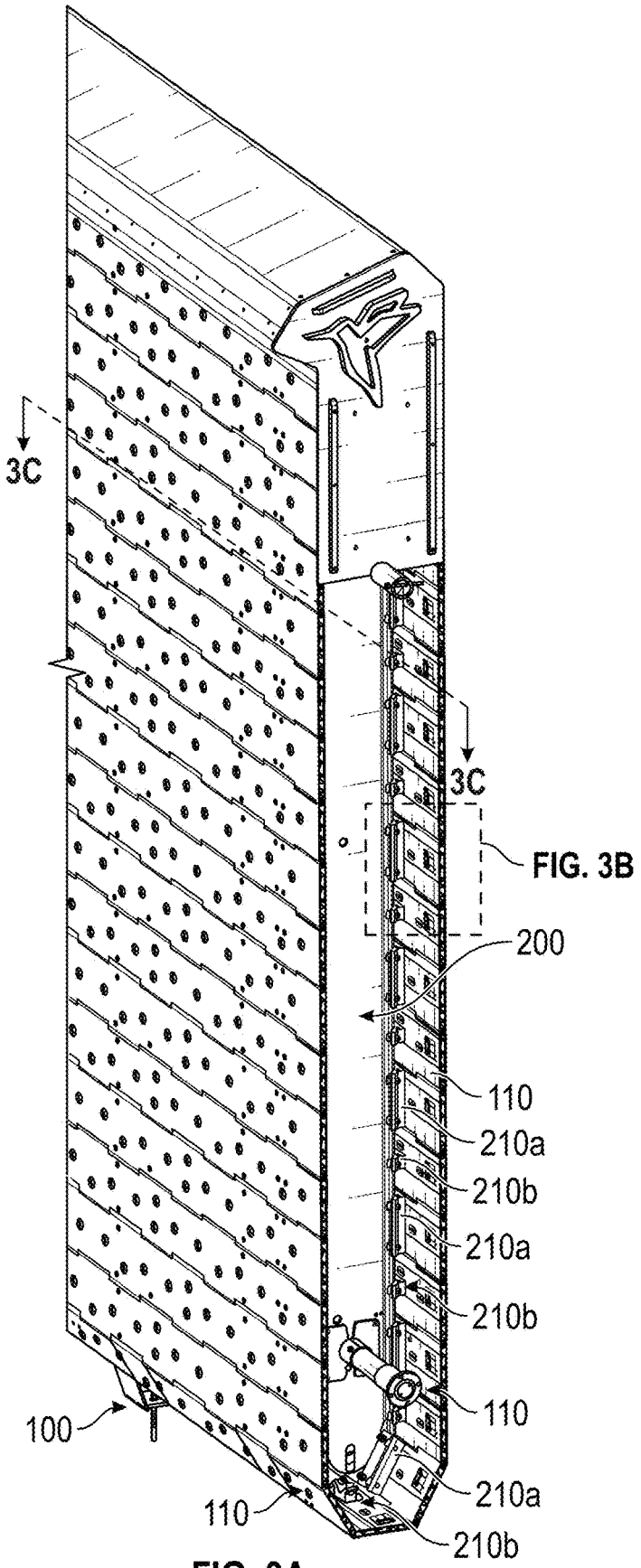
FIG. 3A is a side, perspective view of a board assembly of a rotating climbing wall that is configured in accordance with one or more embodiments of the present disclosure.

FIG. 3A is a side, perspective view of board assembly 100 when some side panels have been removed to reveal a portion of its frame assembly. As described more fully in U.S. patent application Ser. No. 18/159,303, the frame assembly of board assembly 100 may include multiple (e.g., three) uprights 200 around which the slats rotate. Slats 110 can be coupled to uprights 200 (or at least some of uprights 200) via coupling blocks 210*a* and 210*b* (or generally coupling blocks 210). In the depicted embodiments, coupling blocks 210*a* are longer than coupling blocks 210*b*, and these coupling blocks are alternatingly coupled to each slat 110.

Figure 3C:
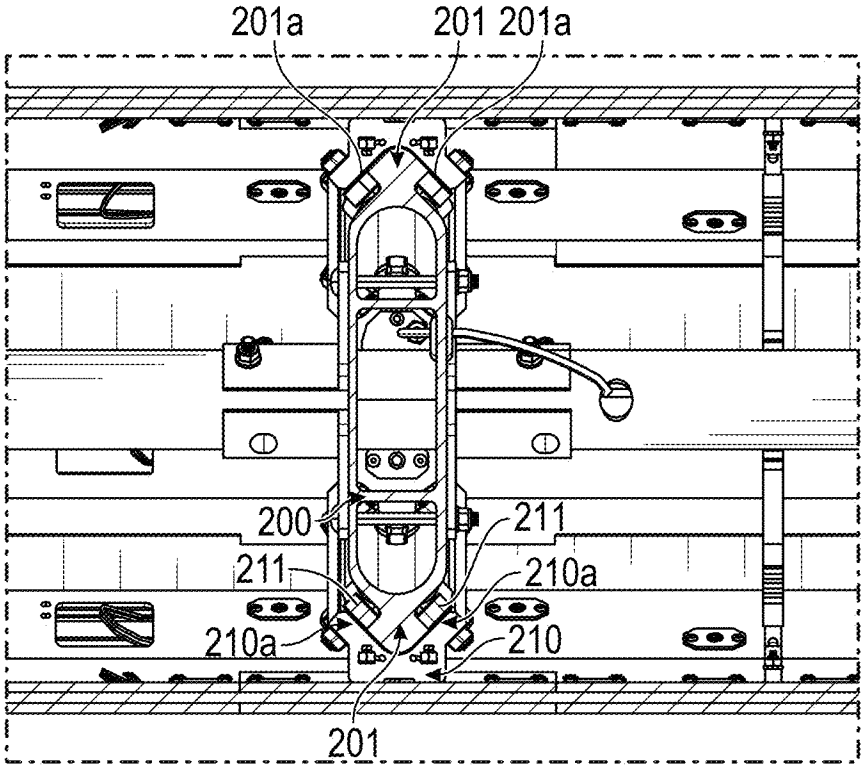
FIG. 3C is a cross-sectional top view of the board assembly of FIG. 3A showing a coupling block that is configured in accordance with one or more embodiments of the present disclosure.

As best shown in FIG. 3C, the outer (e.g., front and rear) ends of upright 200 can each form a rail 201. Each rail 201 can form inwardly oriented coupling faces 201*a*. In this context, "inwardly" refers to the direction that is away from the slat 110 that is coupled to upright 200. In the depicted embodiment, coupling faces 201*a* are oriented at an angle of around 45 degrees from the lengthwise axis of slat 110.

Each coupling block 210 can form a surface 210*a* that matches the outer surface of rail 201 and that is substantially perpendicular to coupling faces 201*a* (e.g., surface 210*a* has a general V shape). Opposing retaining members 211, which can be in the form of rollers or wheels, are secured to surface 210*a* so that their surfaces fit snuggly against coupling faces 201*a*. Due to the orientation of coupling faces 201*a* and their interface with retaining members 211, slats 110 can be prevented from sagging from uprights 200 including when board assembly 100 is tilted forward with the climber hanging from it. In other words, the configuration of uprights 200 and coupling blocks 210 provides a more robust mechanism for supporting the climber's weight regardless of the orientation of board assembly 100.

Figure 4A:
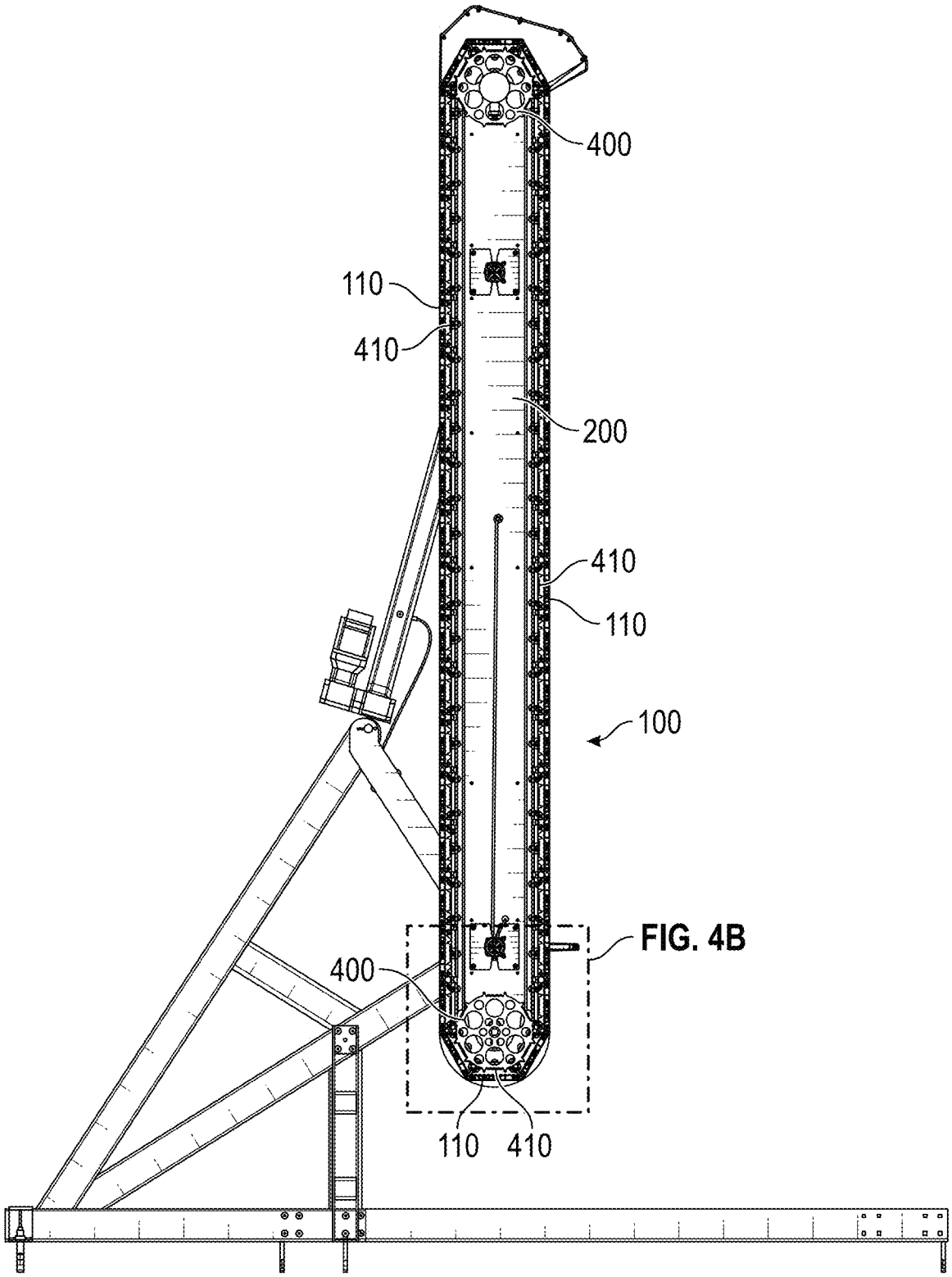
FIG. 4A is a cross-sectional side view of a rotating climbing wall that is configured in accordance with one or more embodiments of the present disclosure.

In some embodiments, rotating climbing wall 10 may include a gear system for increasing the efficiency of power transfer to slats 110. For example, as shown in FIG. 4A, a pair of pinion gears 400 may be positioned at or towards the top and bottom of board assembly 100. In some embodiments, multiple pairs of pinion gears 400 may be provided such as two pairs of pinion gears 400 on each side of board assembly 100. For each pair of pinion gears 400, each slat 110 may include a rack gear 410.

Figure 4B:
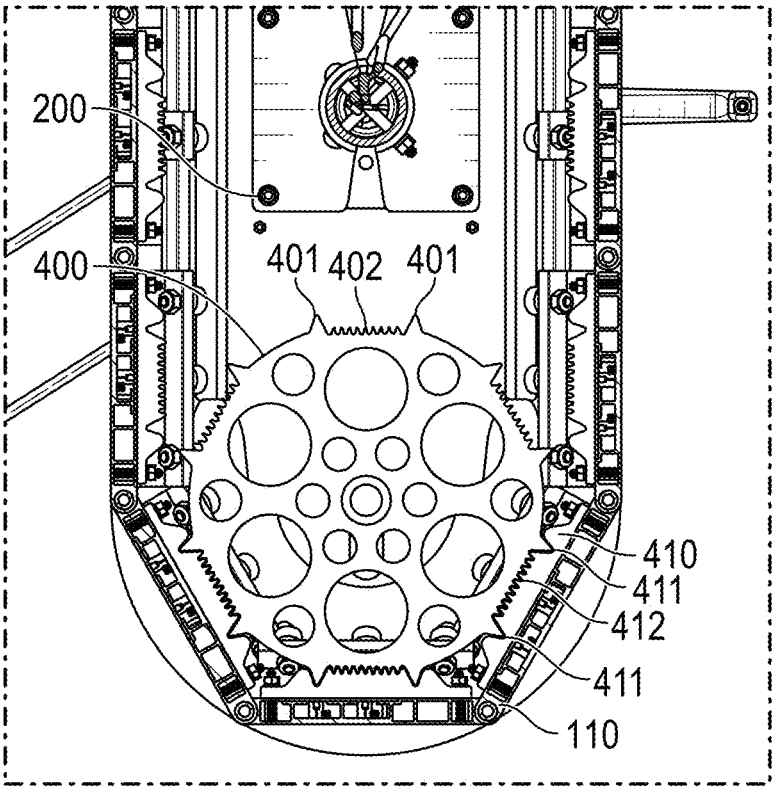
FIG. 4B shows a gear system that may be used on a rotating climbing wall in accordance with one or more embodiments of the present disclosure.

FIG. 4B shows how pinion gear 400 and rack gear 410 may be configured in one or more embodiments. Each pinion gear 400 may include spaced large teeth 401 with a series of small teeth 402 in between, and each rack gear 410 can include corresponding spaced large teeth 411 with a series of small teeth 412 in between. In some embodiments, each pinion gear 400 may include six sets of large teeth 401 and small teeth 402 so that three slats 110 are simultaneously engaged at the top and bottom of board assembly 100.

Figure 4C:
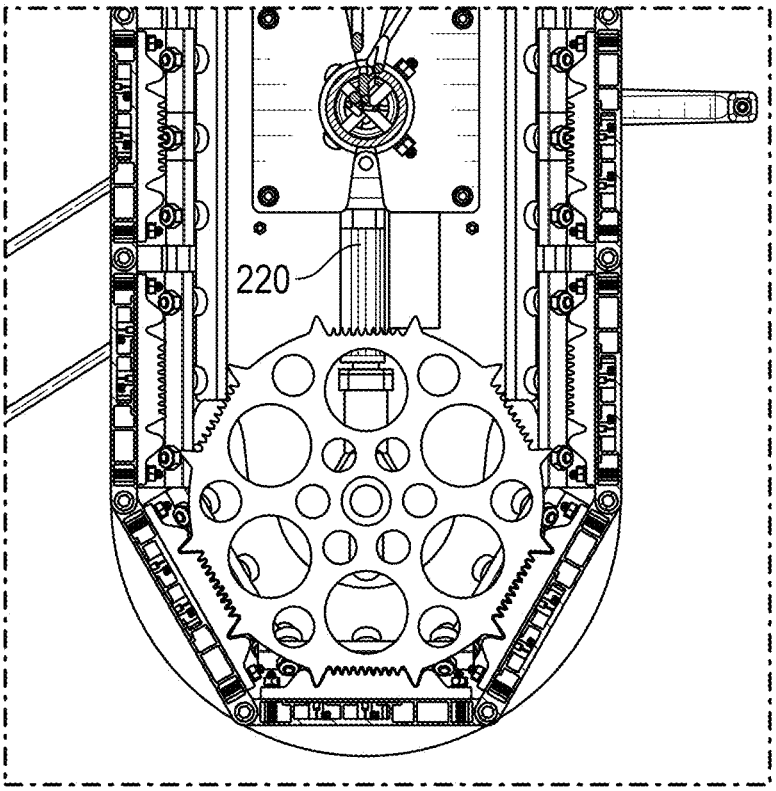
FIG. 4C shows how the slats of FIG. 2A can be tensioned in one or more embodiments of the present disclosure.

A primary function of large teeth 401 and 411 is to facilitate alignment and engagement of pinion gear 400 with rack gear 410 as a slat 110 approaches. Once rack gear 410 and pinion gear 400 are aligned, small teeth 402 and 412 will be engaged and can more effectively translate the rotational force of pinion gears 400 into linear motion of rack gears 410. Board assembly 100 can include linear actuators 220 for tensioning the loop of slats. For example, FIG. 4C shows an example where each upright 200 includes a linear actuator 220 that extends between a bottom rail of support assembly 50 and a bottom pinion gear 400. Accordingly, by extending linear actuators 220, the loop of slats can be tensioned to a desired amount.

FIGS. 5A-5E provides an example of how lights 500 may be integrated into slats 110 in accordance with one or more embodiments of the present disclosure. Lights 500 can be in the form of a ring having a central opening 500*a* (see FIGS. 5C and 5E) through which holds (not shown) can be mounted to slats 110.

Figure 5A:
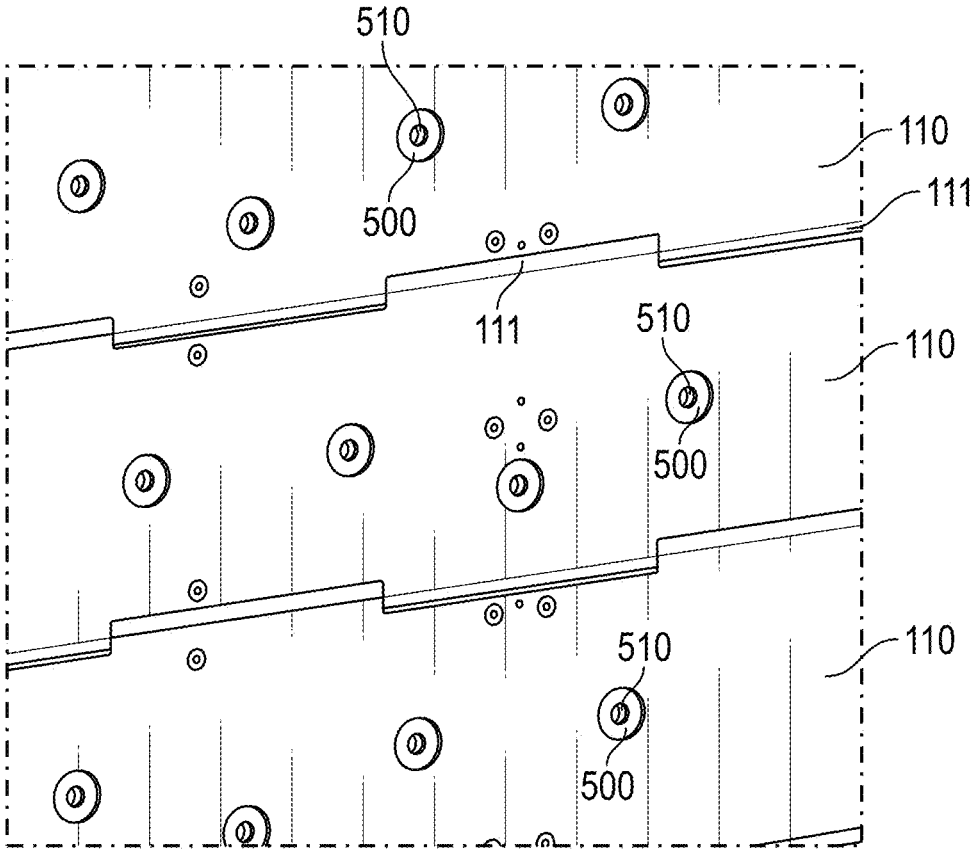
FIG. 5A shows how lights may be integrated into slats in accordance with one or more embodiments of the present disclosure.
Figure 5B:
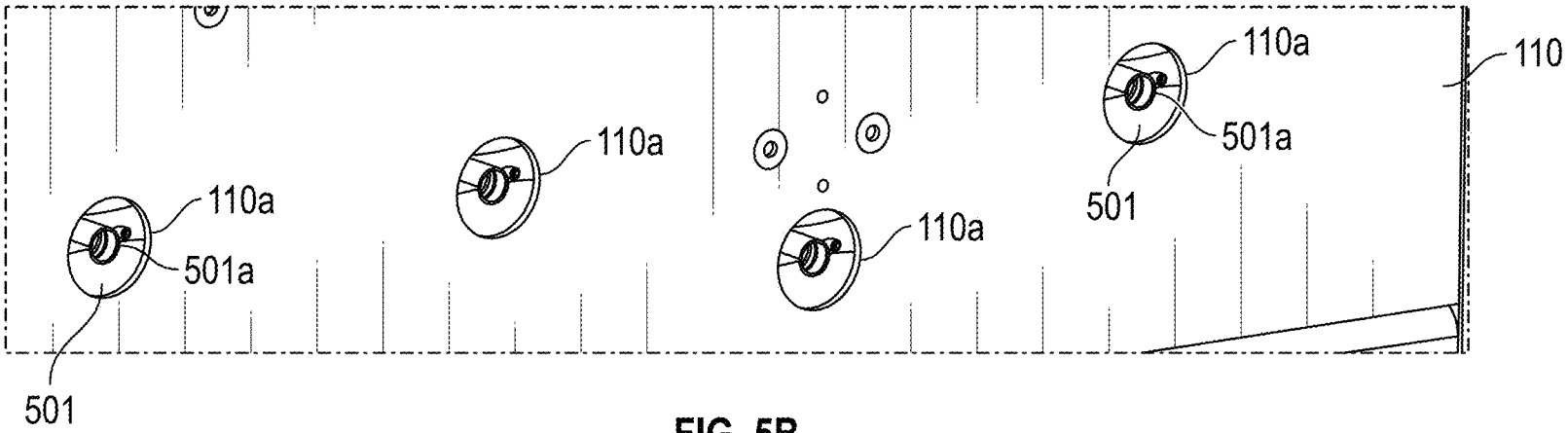
FIG. 5B shows a slat of FIG. 5A with the lights removed.
Figure 5C:
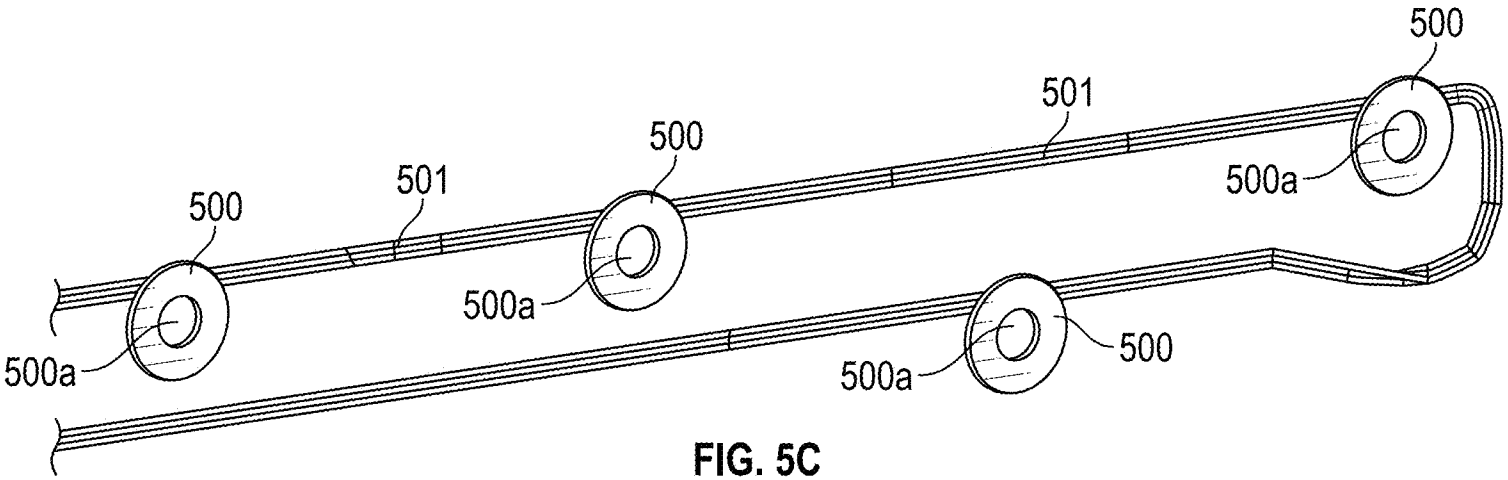
FIG. 5C shows the lights of FIG. 5A in isolation.
Figure 5D:
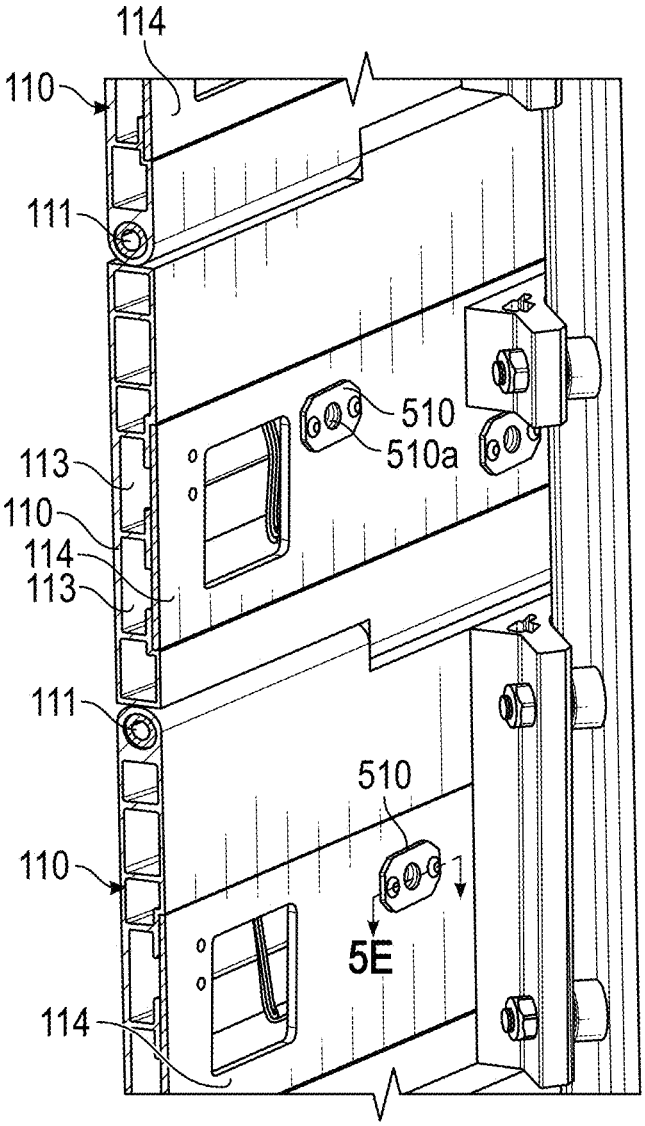
FIG. 5D is an internal view of the slats of FIG. 5A.

As best shown in FIG. 5B where lights 500 are removed from slat 110, each slat 110 can include openings 110*a* which are shaped and sized to receive lights 500. For example, each opening 110*a* can be circular. In some embodiments, each opening 110*a* can include a recessed surface 501 that partially spans the opening and can function to support a light 500. In some embodiments, the depth of recessed surface 501 can match or exceed the thickness of light 500 so that light 500 does not extend beyond the face of slat 110. In some embodiments, recessed surface 501 may form a feature 501*a* that may correspond with central opening 500*a* and may be configured to receive a threaded portion (e.g., a sleeve) 510*a* of a hold securing member 510 (see FIG. 5D).

Figure 3B:
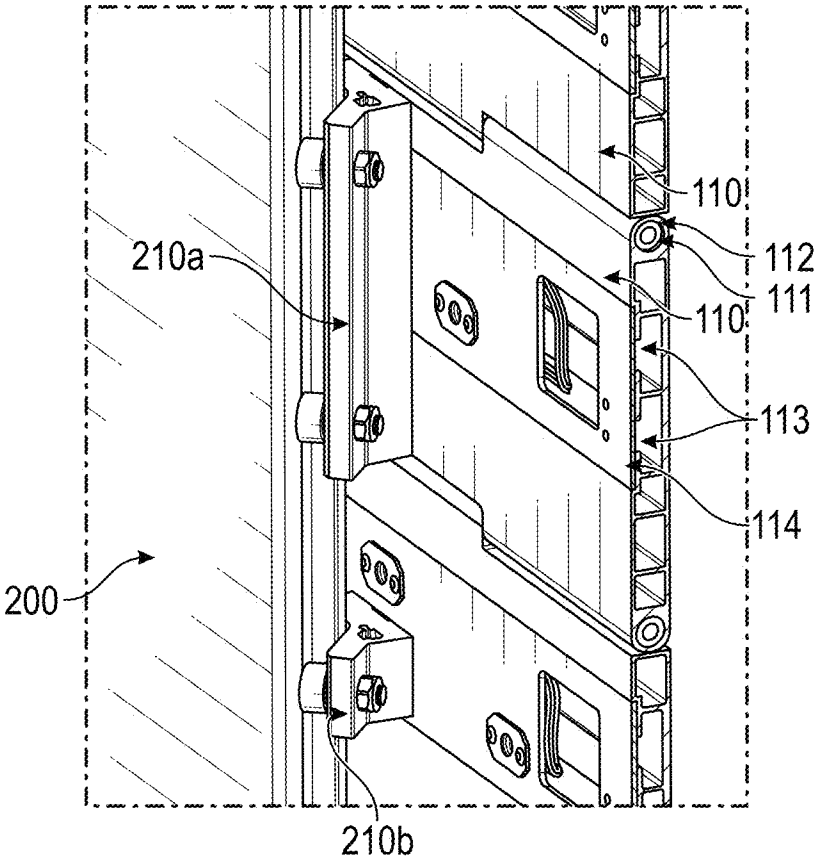
FIG. 3B is an internal view of the board assembly of FIG. 3A showing a coupling block that is configured in accordance with one or more embodiments of the present disclosure.
Figure 5E:
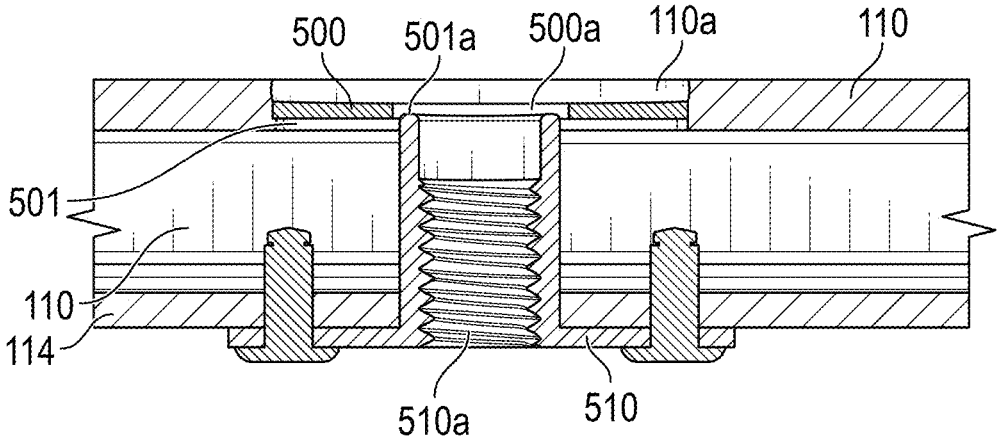
FIG. 5E is a cross-sectional top view of a slat of FIG. 5A.

Each light 500, which could include multiple LEDs, can be interconnected by wires 501. Lights 500 may be inserted into recesses 110*a* from the rear side of slat 110 via hollow portions 113 such that wires 501 extend within hollow portions 113. As best shown in FIGS. 3B and 5E, a cover 114 may be positioned over hollow portions 113 and may be used to position and secure hold securing members 510 behind openings 110*a*. Then, holds can be attached by inserting a bolt, screw or other coupling mechanism of the holds through central opening 500*a* and into threaded portion 510*a*. In some embodiments, coupling blocks 210 may be secured to cover 114.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A rotating climbing wall comprising:

a board assembly comprising a plurality of slats that form a loop; and a plurality of uprights around which the slats rotate, wherein each upright forms opposing rails, each rail having a V-shaped outer surface and opposing coupling faces that extend inwardly from opposing sides of the V-shaped outer surface and are substantially perpendicular to the respective opposing sides of the V-shaped outer surface;

wherein each slat includes coupling blocks for coupling the slat to the opposing rails, each coupling block forming a V-shaped surface that matches the V-shaped outer surface of each rail, each coupling block also including opposing retaining members that are configured to roll along the inwardly extending opposing coupling faces such that the inwardly extending opposing coupling faces interface with the opposing retaining members to prevent sagging of the respective slat relative to the uprights.

2. The rotating climbing wall of claim 1, wherein each slat is pinned to adjacent slats to form the loop, wherein each slat includes a series of channels that are spaced along a top and a bottom of the slat, each series of channels aligning with a corresponding series of channels on an adjacent slat, and wherein a pin extends through the aligned series of channels of adjacent slats to pin the adjacent slats together.

3. The rotating climbing wall of claim 2, wherein an outer surface of the channels is rounded.

4. The rotating climbing wall of claim 1, wherein the inwardly extending opposing coupling faces are flat surfaces oriented at an angle between 30 and 60 degrees relative to a longitudinal axis of the corresponding slat.

5. The rotating climbing wall of claim 1, wherein the board assembly includes one or more pairs of pinions gears positioned at opposing ends of the loop of slats, and wherein the slats include rack gears that engage with the pinion gears.

6. The rotating climbing wall of claim 5, wherein each slat includes a rack gear for each pair of pinion gears.

7. The rotating climbing wall of claim 6, wherein the board assembly includes multiple pairs of pinion gears.

8. The rotating climbing wall of claim 6, wherein each pinion gear and each rack gear includes spaced large teeth with a series of small teeth in between, wherein the spaced large teeth are configured to align engagement of the pinion gears with the rack gears and the series of small teeth are configured to translate rotational force of the pinion gears into linear motion of the rack gears.

9. The rotating climbing wall of claim 1, wherein one or more of the slats are configured to receive lights that each have a central opening that is configured to enable a hold to be mounted to the slat.

10. The rotating climbing wall of claim 9, wherein the one or more slats include openings with recessed surfaces that are configured to receive the lights.

11. The rotating climbing wall of claim 10, wherein each of the one or more slats includes a cover in which hold securing members are positioned, and wherein the cover is positioned overtop one or more hollow portions of the slat which are configured to enable routing of wiring of the lights.

12. The rotating climbing wall of claim 11, wherein each hold securing member includes a threaded portion that aligns with the central opening of a corresponding light.

13. A rotating climbing wall comprising:

interconnected slats that form a loop;

rack gears attached to the slats;

opposing pinion gears that engage with the rack gears to rotate the interconnected slats wherein each pinion gear and each rack gear includes spaced large teeth with a series of small teeth in between, wherein the spaced large teeth are configured to align engagement of the pinion gears with the rack gears and the series of small teeth are configured to translate rotational force of the pinion gears into linear motion of the rack gears; and a plurality of uprights around which the slats rotate, wherein each upright forms opposing rails, each rail having a V-shaped outer surface and opposing coupling faces that extend inwardly from opposing sides of the V-shaped outer surface and are substantially perpendicular to the respective opposing sides of the V-shaped outer surface:

wherein each slat includes coupling blocks for coupling the slat to the opposing rails, each coupling block forming a V-shaped surface that matches the V-shaped outer surface of each rail, each coupling block also including opposing retaining members that are configured to roll along the inwardly extending opposing coupling faces such that the inwardly extending opposing coupling faces interface with the opposing retaining members to prevent sagging of the respective slat relative to the uprights.

14. The rotating climbing wall of claim 13, wherein each slat is pinned to adjacent slats to form the loop, wherein each slat includes a series of channels that are spaced along a top and a bottom of the slat, each series of channels aligning with a corresponding series of channels on an adjacent slat, and wherein a pin extends through the aligned series of channels of adjacent slats to pin the adjacent slats together.

15. The rotating climbing wall of claim 14, wherein an outer surface of the channels is rounded.

16. The rotating climbing wall of claim 13, wherein each slat includes a separate rack gear that engages with the opposing pinion gears.

17. The rotating climbing wall of claim 13, wherein the slats are interconnected by aligning channels of adjacent slats and inserting a pin, which is separate from the slats, through the aligned channels.

18. The rotating climbing wall of claim 13, wherein the inwardly extending opposing coupling faces are flat surfaces oriented at an angle between 30 and 60 degrees relative to a longitudinal axis of the corresponding slat.

19. The rotating climbing wall of claim 13, wherein the inwardly extending opposing coupling faces are oriented at an angle of 45 degrees relative to a longitudinal axis of the corresponding slat.

* * * * *